US009030086B2

(12) United States Patent
Durham

(10) Patent No.: US 9,030,086 B2
(45) Date of Patent: May 12, 2015

(54) SHRINK-FIT CERAMIC CENTER ELECTRODE

(71) Applicant: Federal-Mogul Ignition Company, Southfield, MI (US)

(72) Inventor: Patrick Durham, Troy, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/829,405

(22) Filed: Mar. 14, 2013

(65) Prior Publication Data

US 2013/0293089 A1 Nov. 7, 2013

Related U.S. Application Data

(60) Provisional application No. 61/643,480, filed on May 7, 2012.

(51) Int. Cl.

| | |
|---|---|
| ***H01T 13/20*** | (2006.01) |
| ***H01T 13/52*** | (2006.01) |
| ***F02P 23/04*** | (2006.01) |

(52) U.S. Cl.
CPC ..... *H01T 13/20* (2013.01); *H01T 13/52* (2013.01); *F02P 23/04* (2013.01)

(58) Field of Classification Search
None
See application file for complete search history.

(56) References Cited

U.S. PATENT DOCUMENTS

| | | | | |
|---|---|---|---|---|
| 4,261,085 | A | 4/1981 | Nishio et al. | |
| 4,368,166 | A | 1/1983 | Hinton et al. | |
| 4,400,643 | A | 8/1983 | Nishio et al. | |
| 5,096,769 | A | 3/1992 | Morgan et al. | |
| 5,347,193 | A | 9/1994 | Oshima | |
| 6,166,479 | A | 12/2000 | Matsutani | |
| 7,449,823 | B2 | 11/2008 | Menken et al. | |
| 7,980,908 | B2 | 7/2011 | Niessner et al. | |
| 8,053,966 | B2 | 11/2011 | Walker, Jr. | |
| 2010/0052498 | A1 | 3/2010 | Walker, Jr. | |
| 2013/0003251 | A1 * | 1/2013 | Durham et al. | 361/253 |

FOREIGN PATENT DOCUMENTS

| | | | |
|---|---|---|---|
| DE | 102008043225 | A1 | 4/2010 |
| JP | 1251574 | A | 10/1989 |
| JP | 2027681 | A | 1/1990 |

OTHER PUBLICATIONS

International Search Report, mailed Jun. 5, 2013 (PCT/US2013/031412).

* cited by examiner

*Primary Examiner* — Ashok Patel
(74) *Attorney, Agent, or Firm* — Robert L. Stearns; Dickinson Wright, PLLC

(57) ABSTRACT

An igniter (20) includes an outer insulator (24) formed of an outer ceramic material hermetically sealed to a conductive core (26). The conductive core (26) is formed of a core ceramic material and a conductive component, such as an electrically conductive coating applied to the core ceramic material or metal particles or wires embedded in the core ceramic material. The conductive core (26) is typically sintered and disposed in the green outer insulator (24). The components are then sintered together such that the outer insulator (24) shrinks onto the conductive core (26) and the hermetic seal forms therebetween. The conductive core (26) fills the outer insulator (24), so that the conductive core (26) is disposed at an insulator nose end (34) of the outer insulator (24) and the electrical discharge (22) can be emitted from the conductive core (26), eliminating the need for a separate firing tip.

11 Claims, 2 Drawing Sheets

SHRINK-FIT CERAMIC CENTER ELECTRODE

CROSS REFERENCE TO RELATED APPLICATIONS

This application claims the benefit of U.S. Provisional Patent Application Ser. No. 61/643,480, filed May 7, 2012, which is hereby incorporated by reference in its entirety.

BACKGROUND OF THE INVENTION

1. Field of the Invention

This invention relates generally to igniters for emitting an electrical discharge to ignite a fuel-air mixture, such as corona igniters and spark plugs, and methods of forming the same.

2. Related Art

Igniters of corona discharge ignition systems and conventional spark discharge ignition systems typically include a center electrode formed of an electrical conductive material surrounded by a ceramic insulator. The center electrode typically extends into a combustion chamber and emits an electrical discharge, such as corona discharge or spark discharge. In a corona ignition system, an alternating voltage and current is provided, reversing high and low potential electrodes in rapid succession to enhance formation of the corona discharge. The center electrode of the corona igniter is charged to a high radio frequency voltage potential creating a strong radio frequency electric field in the combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and the corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

Corona igniters and spark plugs are oftentimes assembled such that the clearance between the center electrode and the insulator results in air gaps. Air or another gas from a surrounding manufacturing environment, or from a combustion chamber during operation of the igniter, fills the air gaps. During operation, when energy is supplied to the center electrode, the air in the gaps becomes ionized, creating and electrical field that leads to significant energy losses.

SUMMARY OF THE INVENTION

One aspect of the invention provides an igniter for emitting an electrical discharge. The igniter comprises an outer insulator and a conductive core. The outer insulator is formed of an outer ceramic material, and the conductive core is formed of a core ceramic material and an electrically conductive component. The outer insulator includes an insulator inner surface surrounding a center axis and presenting an insulator bore, and the conductive core is disposed in the insulator bore. The conductive core is hermetically sealed to the insulator inner surface.

Another aspect of the invention provides a method of forming an igniter. The method includes providing an outer insulator formed of an outer ceramic material and having an insulator inner surface presenting an insulator bore, the outer insulator being green; disposing a conductive core formed of a core ceramic material and an electrically conductive component in the insulator bore; and sintering the conductive core and the green outer insulator after disposing the conductive core in the insulator bore. The sintering step includes hermetically sealing the insulator inner surface to the conductive core.

Yet another aspect of the invention is a shrink-fit ceramic center electrode including an outer insulator and a conductive core, and a method of forming the same.

The hermetically sealed outer insulator and conductive core are used in place of the separate insulator and center electrode of the prior art igniters. The hermetic seal eliminates air gaps between components of the igniter and the associated electrical field that forms in the air gaps causing undesirable energy loss. Further, the conductive core and outer insulator together eliminate the need for a conventional center electrode, upper terminal, and conductive glass seal between the upper terminal and ignition coil, thereby reducing costs and manufacturing time. There is also no need for a firing tip, such as a star-shaped corona firing tip or a conventional sparking tip, because the conductive core is capable of emitting the electrical discharge. The conductive core of the corona igniter may also emit a larger diameter electrical field than the center electrodes of the prior art igniters, which may improve energy efficiency during operation.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
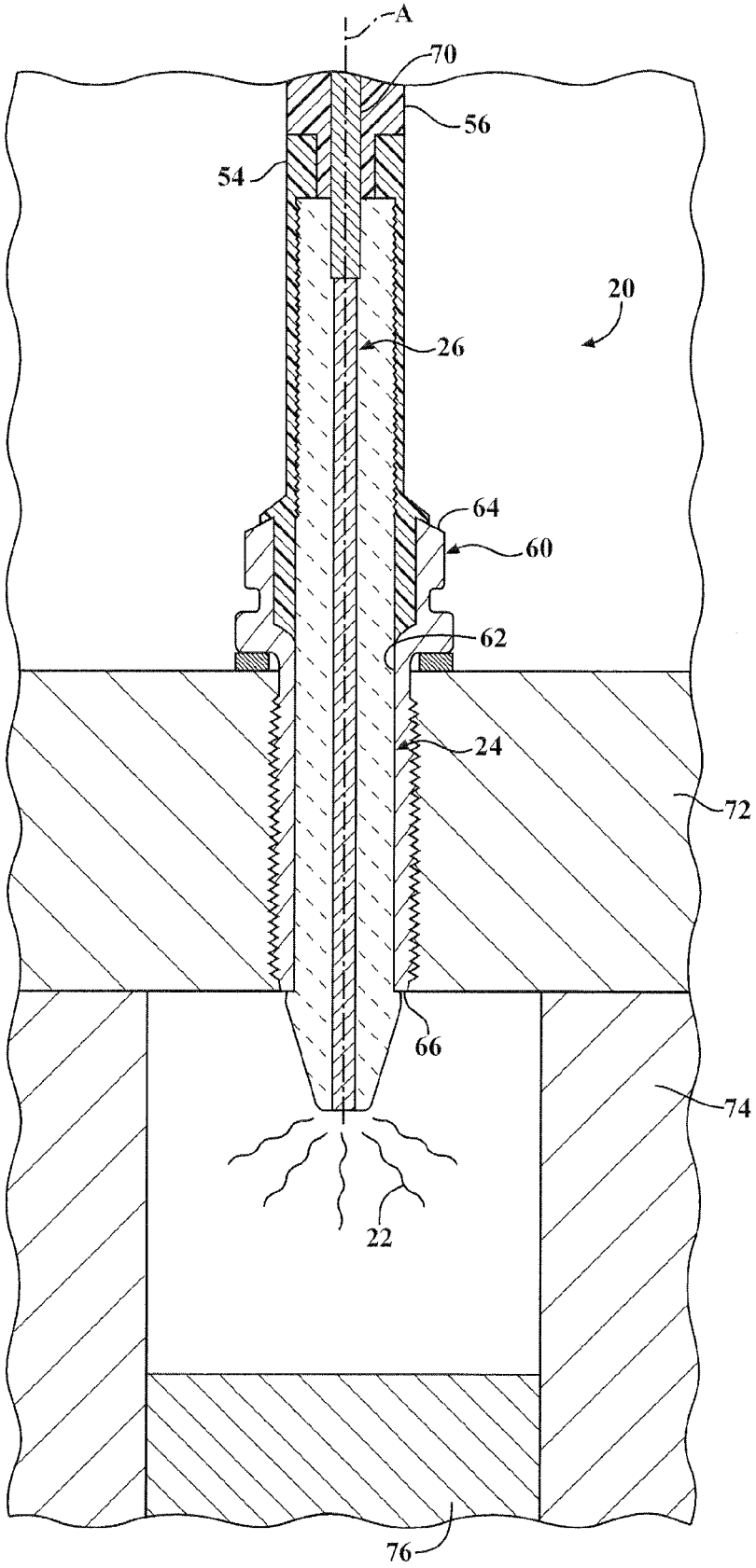
FIG. 1 is a cross-sectional view of a corona igniter disposed in a combustion chamber according to one embodiment of the invention.

One aspect of the invention includes an igniter 20 providing an electrical discharge 22, such as a corona igniter of a corona discharge ignition system or a spark plug of a conventional spark ignition system. The igniter 20 provides improved manufacturing and energy efficiency during operation by including an outer insulator 24 hermetically sealed to a conductive core 26, in place of a separate insulator and center electrode, as in prior art igniters. The hermetically sealed conductive core 26 and outer insulator 24 can be referred to as a shrink-fit ceramic center electrode. The shrink-fit ceramic center electrode eliminates the need for a conventional center electrode, upper terminal, and conductive glass seal between the upper terminal and ignition coil. There is also no need for a firing tip, such as a star-shaped corona firing tip or a conventional sparking tip, because the conductive core 26 is capable of emitting the electrical field. The conductive core 26 of the corona igniter 20 may also emit an electrical field having a larger diameter than the electrical fields emitted by the center electrode of prior art igniters. The larger electrical field may provide a larger discharge 22, which leads to improved energy efficiency during operation. The hermetic seal also eliminates air gaps between the components of the igniter 20 and the associated electrical field that typically forms in the air gaps and causes undesirable energy loss. FIG. 1 shows an example of the corona igniter 20 for receiving energy at a high radio frequency voltage and emitting a radio frequency electric field to ionize a portion of a combustible fuel-air mixture and provide a corona discharge 22.

The outer insulator 24 is formed of an outer ceramic material, such as alumina or another electrically insulating ceramic material. The outer ceramic material is initially provided as a green material, and the green material is then sintered or fired to the conductive core 26 to provide the hermetic seal, also referred to as a shrink-fit, therebetween. The conductive core 26 is typically sintered prior to being disposed in the outer insulator 24. During the sintering step, the outer insulator 24 shrinks onto the conductive core 26 to provide the hermetic seal. Alternatively, the core ceramic material of the conductive core 26 is green when disposed in the outer insulator 24, but has a shrinkage rate equal to or less than the shrinkage rate of the outer insulator 24. Both the outer ceramic material of the outer insulator 24 and the core ceramic material of the conductive core 26 have a shrinkage rate. The shrinkage rate of a material is the dimensional percentage change that occurs during a ceramic densification process, for example a sintering process. The ceramic densification process includes heating to a temperature for a period of time.

Figure 2:
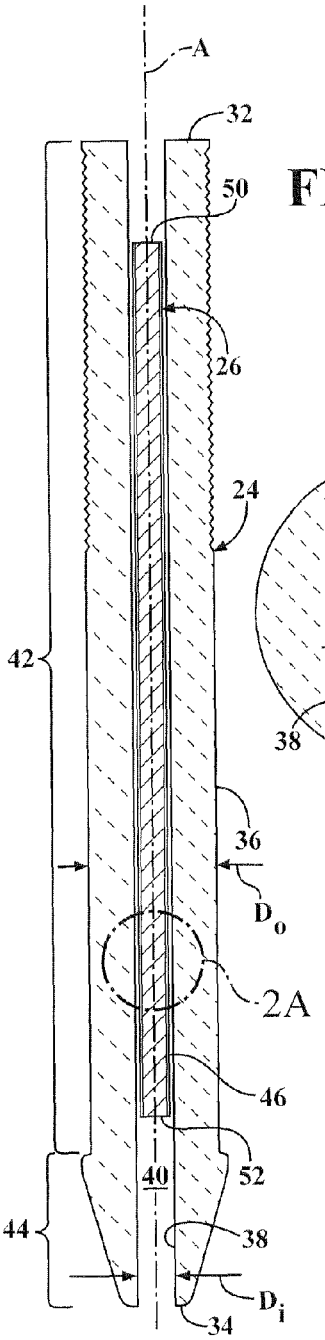
FIG. 2 is a cross-sectional view of a conductive core disposed in an outer insulator prior to sintering the outer insulator according to another embodiment of the invention.
Figure 2A:
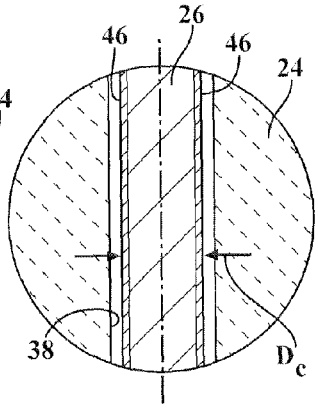
FIG. 2A is an enlarged view of a portion of the conductive core and the outer insulator of FIG. 2.

The dimensions of the outer insulator 24 typically decrease by an amount of 9.6% to 29.6% during the sintering step, and more typically 19.6%. The dimensions of the conductive core 26 shrink by an amount less than the amount of the outer insulator 24. FIGS. 2 and 2A show one example of the conductive core 26 disposed in the outer insulator 24 before sintering, and FIGS. 3 and 3A show the same conductive core 26 and outer insulator 24 after sintering.

The outer insulator 24 extends longitudinally along a center axis A from an insulator upper end 32 to an insulator nose end 34. The outer insulator 24 also presents a length between the insulator upper end 32 to an insulator nose end 34. The outer insulator 24 has an insulator outer surface 36 and an oppositely facing insulator inner surface 38 each presenting an annular shape. The insulator inner surface 38 presents an insulator bore 40 surrounding the center axis A. The insulator outer surface 36 presents an insulator outer diameter $D_o$ and the insulator inner surface 38 presents an insulator inner diameter $D_i$.

Figure 3:
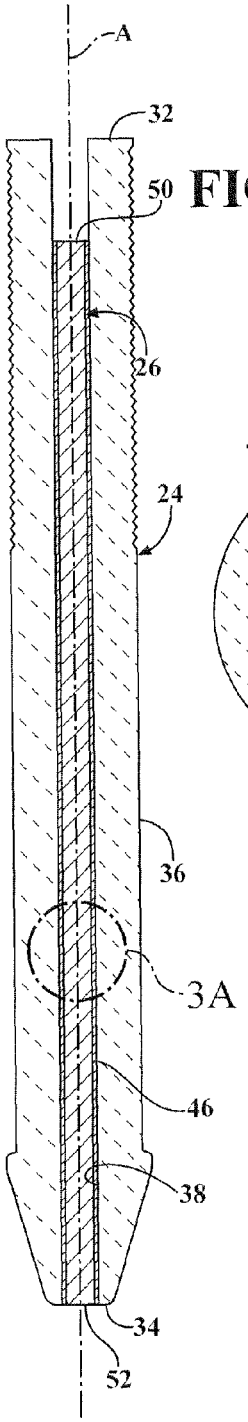
FIG. 3 is a cross-sectional view of the conductive core and the outer insulator of FIG. 3 after sintering.
Figure 3A:
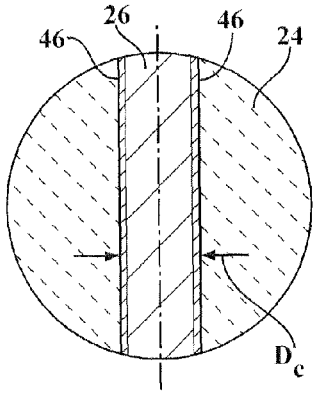
FIG. 3A is an enlarged view of a portion of the conductive core and the outer insulator of FIG. 3.

In the embodiment of FIGS. 1-3, the outer insulator 24 includes a body region 42 extending from the insulator upper end 32 toward the insulator nose end 34. The outer insulator 24 includes a nose region 44 extending from the insulator body region 42 to the insulator nose end 34. In this embodiment, the insulator outer diameter $D_o$ along a portion of the nose region 44 is greater than the insulator outer diameter $D_o$ along the insulator body region 42 such that the outer insulator 24 includes a ledge between the body region 42 and the nose region 44. The insulator nose region 44 then tapers toward the insulator nose end 34 so that the insulator outer diameter $D_o$ at the insulator nose end 34 is less than the insulator outer diameter $D_o$ of the body region 42. The insulator inner diameter $D_i$ is typically constant along the center axis A from the insulator upper end 32 to the insulator nose end 34, such that the insulator inner diameter $D_i$ along the nose region 44 is equal to the insulator inner diameter $D_i$ along the insulator body region 42. However, the outer insulator 24 can comprise other designs.

The conductive core 26 is disposed in the insulator bore 40 and presents a core outer surface 46 hermetically sealed to the insulator inner surface 38. The conductive core 26 is formed of a core ceramic material and a conductive component. The core ceramic material is typically alumina, but can be another ceramic material. The conductive component is typically an electrically conductive metal material, such as a precious metal or precious metal alloy, which may be present in a variety of forms, such as a coating applied to the core ceramic material or particles or wires embedded in the core ceramic material. In another embodiment, the conductive core 26 is formed entirely of an electrically conductive ceramic material, which includes both a core ceramic material and a conductive component.

When the conductive core 26 is disposed in the outer insulator 24 and the outer insulator 24 is sintered, the conductive core 26 has a shrinkage rate not greater than the shrinkage rate of the outer insulator 24. As shown in FIGS. 2 and 3, the dimensions of the conductive core 26 remain fairly consistent while the outer insulator is sintered. The hermetic seal achieved during this sintering step is also referred to an interference fit. The outer insulator 24 shrinks in dimension such that the conductive core 26 is in compression and the outer insulator 24 is in tension. The outer insulator may shrink by 9.6% to 29.6%, and more typically 19.6%.

In one embodiment, the conductive core 26 is sintered before being disposed in the insulator bore 40 of the outer insulator 24, whereas the outer insulator 24 is provided as a green material. The conductive core 26 remains disposed in the insulator bore 40 of the outer insulator 24 while the outer insulator 24 is sintered. During the sintering step, the conductive core 26 has a shrinkage rate of zero and does not shrink at all, while the outer insulator 24 has a positive shrinkage rate and shrinks onto the conductive core 26 to provide the hermetic seal.

In a second embodiment, both the conductive core 26 and the outer insulator 24 shrink when the outer insulator 24 is sintered. The core ceramic material of the conductive core 26 and the outer insulator 24 are both provided as green materials and sintered together, but the outer insulator 24 has a greater shrinkage rate that the conductive core 26 to provide the hermetic seal.

Interference occurs between the outer insulator 24 and the conductive core 26 when the two components press against one another, or when the outer insulator 24 compresses the conductive core 26. The interference is typically diametrical interference and can be expressed as a percentage of the insulator outer diameter $D_o$. The interference typically occurs during the sintering step when the outer insulator 24 shrinks onto the conductive core 26 so that the outer insulator 24 is in tension and the conductive core 26 is in compression. For example, if the outer insulator 24 shrinks a total amount of 100 millimeters (mm), and the interference between is 10 to 20%, then the total interference would be 10 to 20 mm. If the outer insulator 24 shrinks 100 mm, but only compresses the conductive core 26 during the last 30 mm of shrinkage, then the interference is 30%. If the outer insulator 24 shrinks a certain amount and compresses the conductive core 26 during the entire time it is shrinking, then the interference is 100%. If after the sintering step the outer insulator 24 and the conductive core 26 touch, but are not in compression or tension, then there is an interference fit, but the percentage of interference is 0%.

The interference may be expressed as a percentage of the total amount of shrinkage of the outer insulator 24 and may be determined by the following formula:

$$(S_i - S_c) \geq \frac{D_c(1+S_i)}{D_i(1+S_c)} - 1 \geq 0$$

$D_c$ = Green or Sintered Outside Core Diameter $S_c$ = Core Shrinkage Rate (use 0 if sintered)

$D_i$ = Green Insulator Bore Diameter $S_i$ = Insulator Shrinkage Rate

The total interference may also be expressed as a distance, such as millimeters or inches, and may be determined by the following formula:

$$\frac{D_c}{(1+S_c)} - \frac{D_i}{(1+S_i)} \geq 0$$

$D_c$ = Green or Sintered Outside Core Diameter $S_c$ = Core Shrinkage Rate (use 0 if sintered)

$D_i$ = Green Insulator Bore Diameter $S_i$ = Insulator Shrinkage Rate

The diametrical interference between the outer insulator 24 and the conductive core 26 is preferably equal to 0.5 to 10% of the insulator outer diameter $D_o$.

The conductive core 26 extends along a majority of the length of the outer insulator 24 between the insulator upper end 32 and the insulator nose end 34, and preferably fills the insulator bore 40 in the finished igniter 20. The conductive core 26 may extend continuously from a core upper end 50 adjacent the insulator upper end 32 to a core firing end 52 adjacent the insulator nose end 34. The conductive core 26 also extends continuously from the insulator inner surface 38 to the center axis A. The core outer surface 46 faces the insulator inner surface 38 and presents a core diameter $D_c$. Prior to sintering the conductive core 26 and the outer insulator 24 together, the insulator inner diameter $D_i$ is typically greater than the core diameter $D_c$, as shown in FIG. 2A. After sintering, the insulator inner diameter $D_i$ is equal to the core diameter $D_c$, as shown in FIG. 3A.

The conductive core 26 preferably fills the insulator bore 40 so that the conductive component is disposed along the core firing end 52. It is desirable to have the conductive component exposed to air so that it can provide the electrical discharge and eliminate the need for a separate firing tip. In one embodiment, the core firing end 52 is horizontally aligned with the insulator nose end 34, as shown in FIGS. 1 and 3. In one embodiment, the hermetically sealed outer insulator 24 and conductive core 26 are formed by sintering the conductive core 26, disposing the sintered conductive core 26 in the insulator bore 40, and sintering the outer insulator 24 after the conductive core 26 is disposed in the outer insulator 24.

The conductive component of the conductive core 26 includes at least one electrically conductive material, such as platinum, palladium, or another precious metal or precious metal alloy, and is coupled to the core ceramic material. In one embodiment, the conductive core 26 includes a rod formed of the core ceramic material and the conductive component is a coating formed of the electrically conductive metal applied to the rod, as shown in FIGS. 2A and 3A. The coating may be a foil or paint, and may be applied to or painted on the rod before or after sintering the rod. If the core ceramic material of the conductive core 26 and the outer insulator 24 are both provided as green materials and sintered together, then the coating is applied to a green rod before sintering. If the conductive core 26 is sintered before being disposed in the insulator bore 40, then the coating is applied to the rod after sintering the rod, but before being disposed in the insulator bore 40. In the embodiments of FIGS. 1-3, the coating provides the core outer surface 46.

In another embodiment, the conductive core 26 includes the rod formed of the core ceramic material and the conductive component includes an electrically conductive metal material embedded in the rod. For example, the conductive component may be a plurality of metal particles disposed throughout the core ceramic material, or a plurality of metal wires embedded in the core ceramic material. In yet another embodiment, the conductive core 26 includes the rod formed of the core ceramic material, wherein the core ceramic material is an electrically conductive ceramic material such that the conductive component is integral with the core ceramic material.

The core ceramic material of the conductive core 26 and the outer ceramic material of the outer insulator 24 oftentimes blend along the core outer surface 46 and the insulator inner surface 38. In one embodiment, the core ceramic material of the conductive core 26 and the outer ceramic material of the outer insulator 24 are knit together along the core outer surface 46 and the insulator inner surface 38. The ceramic materials each include a crystal structure, and the crystal structures may bond along the core outer surface 46 and the insulator inner surface 38.

As shown in FIG. 1, the igniter 20 also includes a metal shell 60 formed of an electrically conductive material disposed around the outer insulator 24. The metal shell 60 includes a shell inner surface 62 extending from a shell upper end 64 to a shell lower end 66 and presents a shell bore receiving the hermetically sealed outer insulator 24 and conductive core 26. In the embodiment of FIG. 1, the shell lower end 66 rests on the ledge of the outer insulator 24. A first plastic housing 54 providing electrical insulation may be disposed between a portion of the metal shell 60 and a portion of the outer insulator 24, such as between the shell upper end 64 and the outer insulator 24. When the igniter 20 is used in a corona ignition system, a pin 70 formed of an electrically conductive material, such as brass, is coupled to the core upper end 50. The pin 70 may be surrounded by a second plastic housing 56 which provides electrical insulation. The pin 70 is then coupled to the ignition coil (not shown), which is electrically connected, ultimately, to an energy supply (not shown). When the igniter 20 is used in a conventional spark ignition system, a ground electrode (not shown) may be coupled to the shell lower end 66 to form a spark gap between the ground electrode and the core firing end 52. No terminal or glass seal is required in the present igniter 20, which contributes to the reduced manufacturing time and costs.

Another aspect of the invention provides a method of forming the igniter 20. The method includes providing the conductive core 26 formed of the core ceramic material and the conductive component. In one embodiment, the step of providing the conductive core 26 includes forming a rod of the core ceramic material, wherein the core ceramic material is green; sintering the rod; and then applying the conductive component to the sintered rod. The conductive component may be the coating of the electrical conductive metal, so the method includes painting the conductive component on the rod or applying a foil to the rod.

In another embodiment, the step of providing the conductive core 26 includes providing the rod formed of the core ceramic material with the conductive component embedded therein, and then sintering the rod. The method can include embedding the plurality of metal particles in the core ceramic material or embedding the metal wires in the core ceramic material before sintering the rod. In yet another embodiment, the core ceramic material and the conductive component are integral with one another and provided as the electrically conductive ceramic material. In this embodiment, the step of providing the conductive core 26 includes providing the rod formed of the electrically conductive ceramic material and sintering the rod. The step of sintering the conductive core 26 typically includes heating to a temperature of 1000° C. to 1800° C., and preferably 1600° C. The core ceramic material of the conductive core 26 may be provided green, or unsintered, as long as the core ceramic material has a shrinkage rate not greater than the outer ceramic material.

The method also includes providing the outer insulator 24 formed of the outer ceramic material. The outer ceramic material is provided as a green, unsintered material.

The method typically includes disposing the sintered or unsintered conductive core 26 in the insulator bore 40, and then hermetically sealing the conductive core 26 to the outer insulator 24. The hermetic sealing step typically includes sintering or firing the conductive core 26 disposed in the outer insulator 24 at a temperature of 1000° C. to 1800° C., preferably 1600° C.

The sintering step preferably includes shrinking the outer insulator 24 until the core firing end 52 of the conductive core 26 is disposed adjacent the insulator nose end 34. The shrinking preferably occurs until the core firing end 52 is disposed at and horizontally aligned with the insulator nose end 34, as shown in FIG. 3. Before the sintering step, the core diameter $D_c$ is less than or approximately equal to the insulator inner diameter $D_i$, but typically less than the insulator inner diameter $D_i$. The core diameter $D_c$ is typically equal to 75 to 100% of the insulator inner diameter $D_i$ before the sintering step. In one exemplary embodiment, the core diameter $D_c$ is 17.5% less than the insulator inner diameter $D_i$ before the sintering step. However, after the sintering step, the core diameter $D_c$ and the insulator inner diameter $D_i$ are approximately equal. The sintering step also includes compressing the conductive core 26 and tensioning the outer insulator 24 until the interference between the outer insulator and the conductive core is 0.5% to 10% of the insulator outer diameter $D_o$. In one embodiment, the method includes blending of the core ceramic material and the outer ceramic material along the core outer surface 46 during the sintering step.

Once the conductive core 26 and outer insulator 24 are sintered and hermetically sealed, the method includes disposing the hermetically sealed components in the shell bore. When the igniter 20 is a corona igniter, the method includes attaching the pin 70 to the core upper end 50, and attaching the pin 70 to the ignition coil (not shown). The method may also include disposing the second plastic housing 56 around the pin 70 and disposing the first plastic housing 54 between the shell upper end 64 and the outer insulator 24. The shell 60, outer insulator 24, conductive core 26, and housings 54, 56 are typically disposed together in a cylinder head 72 of an internal combustion engine, also shown in FIG. 1. The insulator nose region 44 of the igniter 20 extends into the combustion chamber containing a mixture of fuel and air. The combustion chamber is provided between a cylinder block 74 and a piston 76. The core firing end 52 of the conductive core 26 emits the electrical field that provides the electrical discharge 22, either the corona discharge or spark discharge, to ignite the fuel-air mixture in the combustion chamber.

Obviously, many modifications and variations of the present invention are possible in light of the above teachings and may be practiced otherwise than as specifically described while within the scope of the appended claims.

The invention claimed is:

1. An igniter, comprising:

an outer insulator formed of an outer ceramic material;

said outer insulator including an insulator inner surface surrounding a center axis and presenting an insulator bore;

said outer insulator including an insulator outer surface presenting an insulator outer diameter facing opposite said insulator inner surface;

a conductive core disposed in said insulator bore;

said conductive core being formed of a core ceramic material and an electrically conductive component;

said conductive core being hermetically sealed to said insulator inner surface of said outer insulator and having an interference fit therebetween; and said interference fit between said outer insulator and said conductive core being 0.5% to 10% of said insulator outer diameter.

2. The igniter of claim 1, wherein said outer insulator ends longitudinally from an insulator upper end to an insulator nose end; and including a metal shell disposed around said outer insulator; a first plastic housing disposed between a portion of said metal shell and a portion of said outer insulator adjacent said insulator upper end; a pin formed of an electrically conductive material coupled to said conductive core adjacent said insulator upper end; and a second plastic housing surrounding said pin.

3. The igniter of claim 2, wherein said outer insulator includes an insulator outer surface presenting an insulator outer diameter facing opposite said insulator inner surface; said insulator inner surface presents an insulator inner diameter; said outer insulator includes a body region extending from an insulator upper end toward said insulator nose end and a nose region extending from said insulator body region to said insulator nose end; said insulator outer diameter along at least a portion of said insulator nose region is greater than said insulator outer diameter along said body region; said insulator outer diameter along said insulator nose region tapers to said insulator nose end and is less than said insulator outer diameter along said insulator body region at said insulator nose end; and said insulator inner diameter is constant from said insulator upper end to said insulator nose end.

4. The igniter of claim 1, wherein said conductive core extends continuously from said insulator inner surface to said center axis, and said conductive component of said conductive core is exposed to air.

5. The igniter of claim 1, wherein said outer insulator extends longitudinally along a center axis form an insulator upper end to an insulator nose end and presents a length between said insulator upper end and said insulator nose end; said conductive core extends along a majority the length of said outer insulator from a core upper end to a core firing end; and said core firing end of said conductive core is aligned with said insulator nose end.

6. The igniter of claim 1, wherein said outer insulator and said conductive core each have a shrinkage rate, and the shrinkage rate of said conductive core is not greater than the shrinkage rate of said outer insulator.

7. The igniter of claim 6, wherein the shrinkage rate of said conductive core is less than the shrinkage rate of said outer insulator.

8. The igniter of claim 1, wherein said core ceramic material is alumina and said electrically conductive component includes at least one of platinum and palladium.

9. The igniter of claim 1, wherein said electrically conductive component includes at least one of: a metal coating applied to said core ceramic material; metal particles disposed throughout said core ceramic material; and metal wires embedded in said core ceramic material.

10. The igniter of claim 1, wherein the igniter is a corona igniter for providing a corona discharge.

11. A shrink-fit ceramic center electrode, comprising:

an outer insulator formed of an outer ceramic material;

said outer insulator including an insulator inner surface surrounding a center axis and presenting an insulator bore;

said outer insulator including an insulator outer surface presenting an insulator outer diameter facing opposite said insulator inner surface;

a conductive core disposed in said insulator bore;

said conductive core being formed of a core ceramic material and an electrically conductive component;

said conductive core being hermetically sealed to said insulator inner surface of said outer insulator and having an interference fit therebetween; and said interference fit between said outer insulator and said conductive core being 0.5% to 10% of said insulator outer diameter.

* * * * *